US005460867A

United States Patent [19]

Magnuson et al.

[11] Patent Number: 5,460,867

[45] Date of Patent: Oct. 24, 1995

[54] SEPARATION LAYER FOR LAYING GRASS-SURFACES ON SAND-AND/OR GRAVEL BASE

[75] Inventors: Lars Magnuson, Sollebrunn; Lennart Rantzen, Alingsas, both of Sweden

[73] Assignee: Profu AB, Sweden

[21] Appl. No.: 178,246

[22] PCT Filed: Jul. 6, 1992

[86] PCT No.: PCT/SE92/00506

§ 371 Date: May 13, 1994

§ 102(e) Date: May 13, 1994

[87] PCT Pub. No.: WO93/01356

PCT Pub. Date: Jan. 21, 1993

[30] Foreign Application Priority Data

Jul. 8, 1991 [SE] Sweden ..... 9102133

[51] Int. Cl.[6] ..... A01N 3/00; B32B 3/28

[52] U.S. Cl. ..... 428/178; 428/17; 428/166; 428/172; 428/174; 428/188; 405/36; 405/38; 52/169.5

[58] Field of Search ..... 428/156, 178, 428/167, 172, 174, 119, 120, 137, 166, 188, 17, 95; 52/792, 814, 169.5; 57/4; 405/36, 38

[56] References Cited

U.S. PATENT DOCUMENTS

| | | | |
|---|---|---|---|
| 4,639,165 | 1/1986 | Flectnoe-Brown | 405/45 |
| 4,840,515 | 6/1989 | Freese | 428/178 |
| 4,889,758 | 12/1989 | Rinkwich | 428/178 |
| 4,917,933 | 4/1990 | Schluter | 428/178 |
| 5,399,406 | 3/1995 | Matsuu et al. | 428/57 |

FOREIGN PATENT DOCUMENTS

| | | |
|---|---|---|
| 8866182 | 3/1986 | Australia . |
| 155161 | 2/1989 | Denmark . |
| 127933 | 9/1973 | Norway . |

*Primary Examiner*—Donald J. Loney
*Attorney, Agent, or Firm*—Lerner, David, Littenberg, Krumholz & Mentlik

[57] ABSTRACT

A separation layer (12) for laying grass surfaces (10; 16) on a sand or gravel base (13), which layer is in the form of a rigid plastic sheeting with parallel side edges. The surface of the sheeting is embossed by thermo-forming so that it presents a uniform pattern of deep embossings (14). These form rows which extend perpendicular to said side edges. The parallel rows are each connected to adjacent embossings in the same row via bridges (15) so that each row of embossings in cooperation with adjacent rows creates a stiffening of the sheeting.

21 Claims, 2 Drawing Sheets

SEPARATION LAYER FOR LAYING GRASS-SURFACES ON SAND-AND/OR GRAVEL BASE

TECHNICAL FIELD

The present invention relates to a separation layer for laying grass surfaces on a sand and/or gravel base, which layer is in the form of a rigid plastic sheeting with parallel side edges. The invention further relates to uses of this separation layer for laying grass surfaces on a sand and/or gravel base.

BACKGROUND OF THE INVENTION

The laying of artificial or natural grass for various sporting purposes invariably results in high costs. The result is primarily dependent upon how well the under surface or base has been prepared. For example it is important that the drainage is adequate. In addition the outer layer of sand and gravel must be separated from layers of clay beneath so that these do not migrate upwards and damage the grass layer. There are various types of separation layers for this purpose, for example so called geo-textile which forms a barrier layer between for example clay and macadam.

When laying artificial grass surfaces, for example for football or tennis, the artificial grass is laid upon a drainage rubber matting, so called Dimple Pad. Up until now attempts to lay this matting (artificial grass and Dimple Pad) directly onto a sand/gravel base have been shown to give rise to problems in the form of abrasion damage to the rubber matting. Should this wear become such that holes are created in the matting, this will be clearly noticed because a ball will bounce irregularly. In addition the damage can propagate upwardly into the supporting layer of the artificial grass whereby players can be seriously injured should the studs snag in the damage.

Known geo-textiles have not been able to withstand the stresses which arise in this special area of use. It is thus common that this type of artificial grass is laid on an asphalt base which is, of course considerably more expensive than sand or gravel.

TECHNICAL PROBLEM

An object with the present invention is thus to provide a separation layer which permits the laying of grass surfaces on a sand or gravel base which avoids the above described problems. A second object with the invention is to indicate uses of the separation layer for laying of artificial and natural grass surfaces on a sand or gravel base and possibly with an internal heat exchange surface.

SOLUTION

The object is achieved according to the present invention by means of the surface of the sheeting being embossed by thermo-forming so that it presents a uniform pattern of deep embossings which form rows which extend perpendicularly to said side edges, wherein the parallel rows are each connected to adjacent embossings in the same row via bridges so that each row of embossings in cooperation with adjacent rows creates stiffening of the sheeting.

When using the separation layer for laying of an artificial grass surface on a sand or gravel base, the layer lays on the sand or gravel base and a drainage layer in the form of a drainage rubber matting rests on top of the separation layer and the artificial grass lays on top of the drainage layer.

When using the separation layer for laying of a natural grass surface on a sand or gravel base, the separation layer lays on the sand or gravel base and a layer of soil rests on top of the separation layer and the natural grass is laid on top of the soil layer.

When using the separation layer for laying a heat exchange surface which is covered by a grass surface, at least two separation layers lie on top of one another on the sand or gravel base with crossing bridges and a heat transferring medium is passed through the space between the two separation layers which form the base for the grass surface.

BRIEF DESCRIPTION OF THE DRAWINGS

Embodiments of the invention will now be described with reference to the attached drawings in which.

PREFERRED EMBODIMENTS

Figure 1:
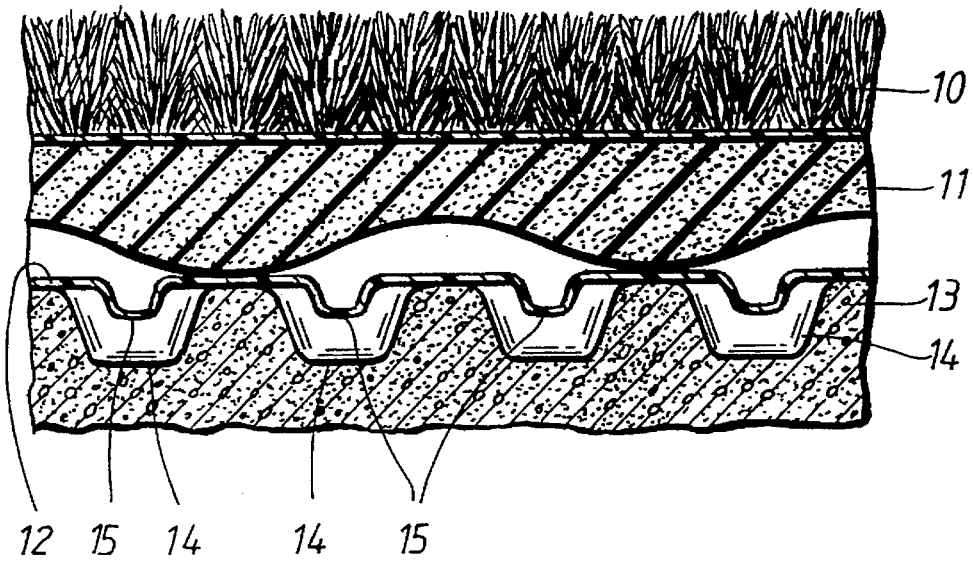
FIG. 1 is a vertical cross-section through an artificial grass matting according to the invention.

The artificial grass surface 10 of FIG. 1 rests on a rubber matting 11 with drainage properties which has a lower surface provided with hollows. The rubber matting 11 rests in turn on a separation layer 12 which is laid on top of a support surface 13 of sand or gravel.

The separation layer 12 is made from a rigid plastic sheeting, the surface of which is thermo-formed so that it presents a uniform pattern of deep embossings 14. These form rows which extend perpendicular to two of the sheeting's opposite side edges. The parallel rows are each connected to adjacent embossings 14 in the same row via bridges 15 (see also FIG. 3) so that each row of embossings in cooperation with adjacent rows creates a stiffening of the sheeting. The sheeting suitably has a thickness of c:a 0,4–1,2 millimeters.

The embossings 14 accordingly extend in parallel rows over the entire surface of the sheeting and can be used for fastening of adjacent sheet sections, either by means of the sections overlapping each other by a width corresponding to a certain number of embossings which thereby lock into each other, or by means of small sheet section being used to link together larger sheet sections which abut at their edges.

Because of a pre-prepared camber of the base surface 13, rain water which passes through the artificial grass surface 10 and the rubber matting 11 runs via the bridges 15 to the side of the grass field where the drains are suitably arranged. The separation layer 12 can also be provided with not shown perforations in order to let through a certain quantity of liquid, for example to a pre-existing drainage system.

It will apparent from FIG. 1 that the separation layer 12 is sunk into the base layer 13, i.e. the base layer moulds itself to the permanently shaped separation layer. In this manner the shape of the rubber matting is substantially maintained so that its resilient properties are not negatively affected. The distribution of the downwardly directed peaks of the rubber matting does not need to be in any particularly relation to the distribution of the embossings, which implies that the rubber matting will engage in regions of the separation layer 12. The separation layer can of course also be used together with a normal flat rubber matting.

Figure 2:
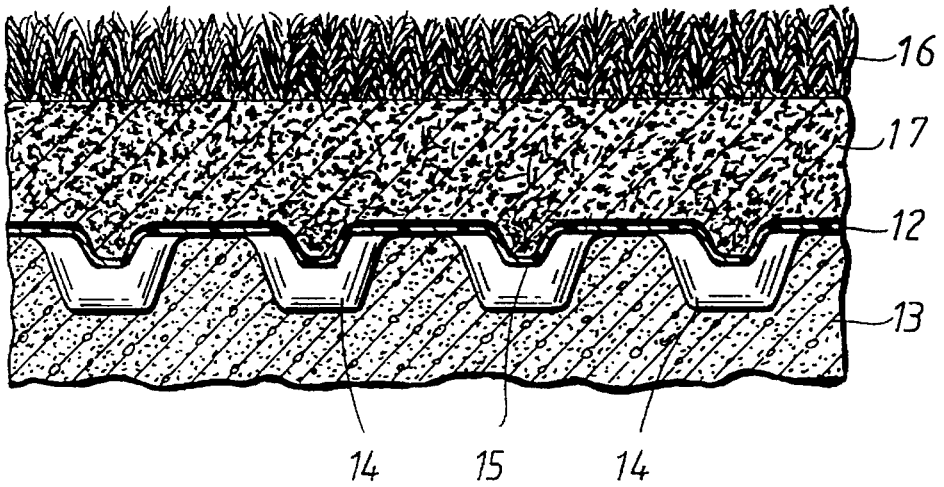
FIG. 2 is a vertical cross-section through a natural grass matting according to the invention.

FIG. 2 shows a natural grass surface 16 which grows in a layer of soil 17 which rests on the separation layer 12 which in itself is supported by the base layer 13. The rectangularly shaped embossings 14 form small cups for collection of rain water or sprinkler water which is effectively distributed across the grass field via the bridges 15. This implies that the grass field can be watered without unnecessary waste which can be a big advantage where the access to water is restricted.

Figure 3:
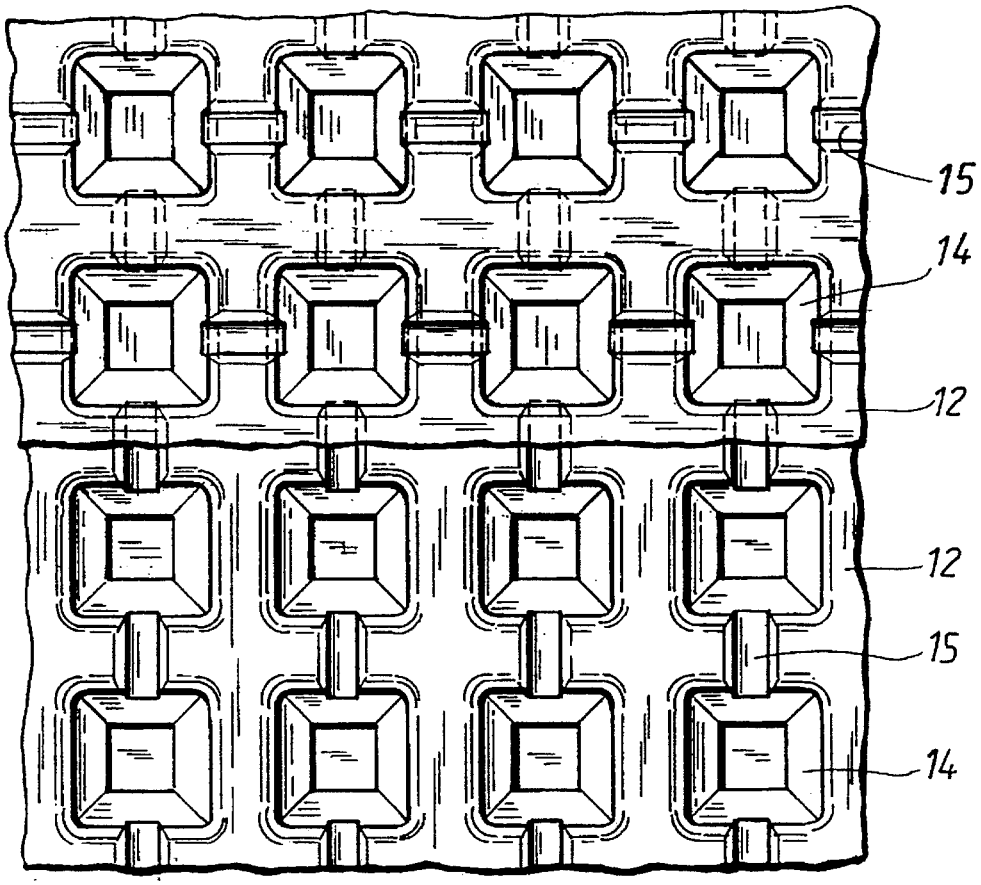
FIG. 3 is a plan view of an artificial grass matting according to the invention with heat exchange properties.
Figure 4:
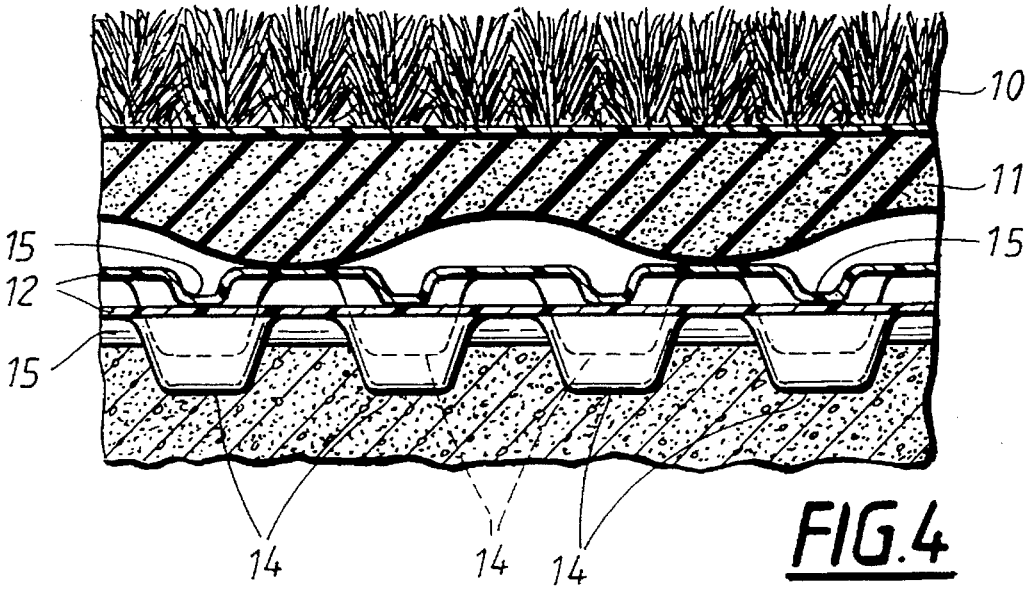
FIG. 4 is a vertical cross-section through the matting of FIG. 3.

FIGS. 3 and 4 show how the separation layer 12 can be used to provide a heat exchange surface for a grass field. Two or more separation layers are hereby laid on top of another so that the bridges 15 cross each other and form separation members. Thereafter the space between the separation layers can be used for the distribution of a heat exchange medium, for example heated air or a cooling medium. For this purpose lists are provided along the edges of the assembly (not shown in the drawings), which lists are provided with means for the supply and extraction of the heat exchange medium, together with sealing means to avoid leakage. In this way snow and ice for example can be removed from a football pitch during winter. Alternatively it is possible to artificially freeze a surface.

In addition to the above mentioned advantages, a further advantage which arises is that a ball, which is allowed to drop on a surface under which a separation layer according to the invention has been used, bounces back in an advantageous manner. This re-bounding of the ball should not be too great. Experiments have been carried out to determine the re-bound and the results of these experiments which have been performed according to German norm DIN 18035/7 clearly illustrate the blocking layer's excellent properties in this respect. The results of these experiments are given below.

The experiments were carried out on a ball with a weight of 457 grams and a diameter of 21,8 centimeters which was allowed to drop from a height of circa 140 centimeters onto to an artificial grass surface with a grass height of 33 millimeters which was laid on a rubber material as shown in the drawings under which the separation layer according to the present invention was present during half of the experiment. The separation layer in turn was positioned partly on lose sand and partly on compacted sand.

The following values were obtained:

| Ball-rebound according to DIN 18035/7 | | | |
|---|---|---|---|
| Rubber material 5410 (kg/m³) | Thickness | Rebound in m | Rebound in % |
| on compacted base layer without separation layer | | | |
| 5410 | 10 mm | 1,25 m | 89% |
| 5410 | 12 mm | 1,20 m | 86% |
| on compacted base layer with separation layer | | | |
| 5410 | 10 mm | 1,08 m | 77% |
| 5410 | 12 mm | 1,05 m | 75% |
| on base layer without separation layer | | | |
| 5410 | 10 mm | 1,20 m | 86% |
| 5410 | 12 mm | 1,18 m | 84% |

-continued

| Ball-rebound according to DIN 18035/7 | | | |
|---|---|---|---|
| on base layer with separation layer | | | |
| 5410 | 10 mm | 1,05 m | 75% |
| 5410 | 12 mm | 1,02 m | 73% |
| Rubber material 6010 SH (kg/m³) | Thickness | Rebound in m | Rebound in % |
| on base layer without separation layer | | | |
| 6010 SH | 10 mm | 1,20 m | 86% |
| 6010 SH | 12 mm | 1,15 M | 82% |
| on base layer with separation layer | | | |
| 6010 SH | 10 mm | 1,08 m | 77% |
| 6010 SH | 12 mm | 1,05 m | 75% |
| on base layer without separation layer | | | |
| 6010 SH | 10 mm | 1,12 m | 80% |
| 6010 SH | 12 mm | 1,10 m | 79% |
| on base layer with separation layer | | | |
| 6010 SH | 10 mm | 1,05 m | 75% |
| 6010 SH | 12 mm | 1,00 m | 71% |
| Rubber material 5410 | Thickness | Rebound in m | Rebound in % |
| 5410 | 10 mm | 1,10 m | 79% |
| 5410 | 12 mm | 1,15 m | 82% |
| 5410 | 15 mm | 1,03 m | 74% |
| 5410 | 9/13 mm | 0,83 m | 59% |
| 6010 SH | 10 mm | 1,12 m | 80% |
| 6010 SH | 12 mm | 1,08 m | 77% |
| 6010 SH | 14 mm | 1,08 m | 76% |
| 6010 SH | 9/13 mm | 0,95 m | 68% |
| Rubber material 3008 (kg/m³) | Thickness | Rebound in m | Rebound in % |
| on base layer without separation layer | | | |
| 3008 | 12 mm | 1,10 m | 79% |
| 3008 | 14 mm | 1,08 m | 77% |
| 3008 | 16 mm | 1,05 m | 75% |
| on base layer with separation layer | | | |
| 3008 | 12 mm | 0,89 m | 63% |
| 3008 | 14 mm | 0,85 m | 61% |
| 3008 | 16 mm | 0,84 m | 60% |
| on base layer without separation layer | | | |
| 3008 | 12 mm | 1,08 m | 77% |
| 3008 | 14 mm | 0,98 m | 70% |
| 3008 | 16 mm | 0,95 m | 68% |
| on base layer with separation layer | | | |
| 3008 | 12 mm | 0,82 m | 59% |
| 3008 | 14 mm | 0,80 m | 57% |
| 3008 | 16 mm | 0,76 m | 54% |

A maximum value of the rebound should be 80% and a clear difference between the rebound where the separation is used and that where it is not used is clearly illustrated.

The invention is not restricted to the above described embodiments and several variants are conceivable within the scope of the appended claims. For example the embossings can be differently shaped. The separation layer can also be used with upwardly directed embossings. The artificial grass surface 10 can be used with or without an upper layer of sand. The separation layer according to the invention can also accordingly be used for laying of grass surfaces for other different sports, such as golf, land-hockey and American football.

We claim:

1. A separation arrangement for a grass surface, comprising a grass surface, an intermediate layer supporting said grass surface, a base layer, a space between said intermediate and base layers, a separation layer extending within said space along said grass surface, said separation layer comprising a plurality of depressions and elongated recesses extending outwardly therefrom in the direction of said base layer, said recesses interconnecting said depressions and forming bridges facilitating movement of fluids within the separation arrangement, said base layer fixedly receiving at least said depressions.

2. A separation arrangement of claim 1, further comprising said depressions having top and bottom portions, said recesses having the depth substantially smaller than the depth of said depressions, said recesses extending within said depressions below the level of said top portion.

3. The separation arrangement of claim 1, wherein said grass surface is an artificial grass surface and said intermediate layer is formed of a resilient material.

4. The separation arrangement of claim 3, wherein said resilient material is a drainage rubber matting and said recesses being formed with appertures facilitating penetration of said fluids from said recesses into said depressions.

5. The separation arrangement of claim 3, wherein said base layer is made of a material selected from the group consisting of sand and gravel.

6. The separation arrangement of claim 3, wherein a plurality of openings is provided between a top surface of the separation layer and a bottom surface of the intermediate layer.

7. The separation arrangement of claim 3, wherein said fluids upon passing through the artificial grass surface and the rubber matting of the intermediate layer is accumulated within said separation layer and through said bridges being directed for collection at least at one end of said separation layer.

8. The separation arrangement of claim 2, wherein said grass surface is a natural grass surface and said intermediate layer is a layer of soil resting on said separation layer.

9. The separation arrangement of claim 8, wherein an upper surface of said intermediate layer engages said layer of soil so that said recesses are filled with said layer of soil.

10. The separation arrangement of claim 8, wherein said fluids passing through said natural grass surface and said layer of soil is accumulated within said separation layer and directed to said depressions, whereby said depressions collect said fluids enhancing distribution of said fluids across said natural grass surface via said bridges.

11. The separation arrangement of claim 10, wherein said base layer is made of a material formed from the group consisting of sand and gravel.

12. The separation arrangement of claim 1, further comprising at least two adjacent separation layers positioned on top of each other, said layers being at least partially spaced from each other to form a plurality of channels for distribution of a heat exchange medium along said grass surface.

13. The separation arrangement of claim 12, further comprising isolating elements positioned at either end of said channels to control delivery of said medium to the channels and dissipation of heat therefrom.

14. The separation arrangement of claim 13, further comprising means for supplying and extraction of said heat exchange medium to and from said channels.

15. The separation arrangement of claim 12, wherein each said channel is positioned between two adjacent recesses.

16. The separation arrangement of claim 12, further comprising another separation layer having a plurality of interconnected depressions and elongated recesses, said separation layers being positioned on top of each other, so said depressions of said both separation layers coincide and their elongated recesses being transverse to each other, said separation layers being spaced from each other and forming a plurality of channels therebetween for distribution of a heat exchange medium along said grass surface.

17. A separation arrangement for a grass surface, comprising a grass surface, an intermediate layer supporting said grass surface, a base layer, a space between said intermediate and base layers, a first separation layer extending within said space along said grass surface, said first separation layer including a plurality of depressions and elongated recesses extending outwardly therefrom, said recesses interconnecting said depressions, a second separation layer having a plurality of interconnected depressions and elongated recesses, said first and second separation layers being positioned on top of each other and being spaced from each other, so as to form a plurality of channels therebetween for distribution of a heat exchange medium along said grass surface.

18. The separating arrangement of claim 17, wherein said depressions of said separation layers coincide and their elongated recesses being transverse to each other.

19. The separation arrangement of claim 17, further comprising isolating elements positioned at either end of said channels to control delivery of said medium to the channels and dissipation of heat therefrom.

20. The separation arrangement of claim 19, further comprising means for supplying and extraction of said heat excahnge medium to and from said channels.

21. The separation arrangement of claim 17, wherein each said channel is positioned between two adjacent recesses.

* * * * *